United States Patent [19]

Wlodarski et al.

[11] 4,127,333

[45] Nov. 28, 1978

[54] CONTINUOUSLY OPERATED CONE-AND-SCREW MIXER

[75] Inventors: Andrzej Włodarski; Krystyna Dramińska, both of Warsaw; Władysław Opłotny, Marki; Andrzej Mickiewicz; Michał Komar, both of Warsaw, all of Poland

[73] Assignee: Instytut Chemii Przemslowej, Warsaw, Poland

[21] Appl. No.: 783,400

[22] Filed: Mar. 31, 1977

[30] Foreign Application Priority Data

Apr. 9, 1976 [PL] Poland ..... 188658

[51] Int. Cl.[2] ..... B01F 15/02

[52] U.S. Cl. ..... 366/131; 366/287

[58] Field of Search ..... 259/5, 21, 40, 64, 114, 259/102, 118; 366/182, 150, 154, 156, 242, 261, 287, 290

[56] References Cited

U.S. PATENT DOCUMENTS

| | | | |
|---|---|---|---|
| 2,574,391 | 11/1951 | Herrly | 259/5 |
| 3,775,863 | 12/1973 | Updegrove | 259/40 |

*Primary Examiner*—Robert W. Jenkins

[57] ABSTRACT

A cone-and-screw mixer for mixing powders, granulates or polydisperse granular materials having a conical vessel accommodating a screw simultaneously rotating about its own axis and around the axis of the vessel. The mixer is provided with an inlet opening located in a cover, a pipe fitting located in the bottom and an overflow opening located between the inlet opening and the upper flight end of the screw. The area of the overflow opening is preferably equal to that of the inlet opening, whereas the angle included between the vertical planes passing through the mixer axis and through the points being least distant from each other and located at the edges of the overflow and the inlet openings is not less than 0.35 rad.

5 Claims, 2 Drawing Figures

CONTINUOUSLY OPERATED CONE-AND-SCREW MIXER

Figure 1:
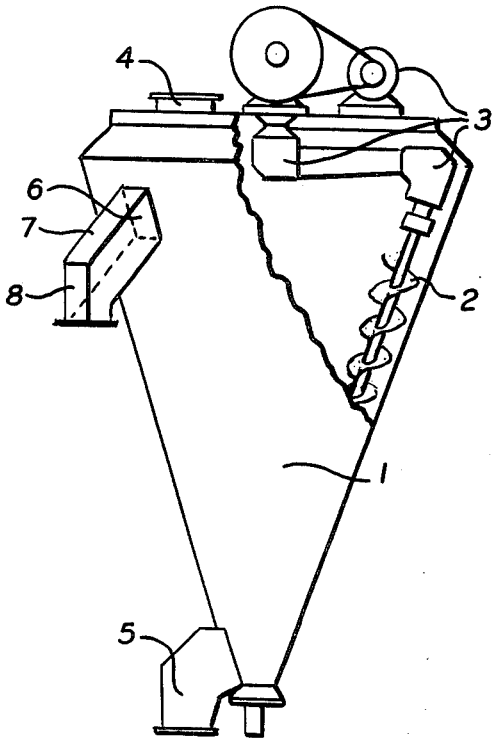

The subject of the present invention is a continuous-discharge, cone-and-screw mixer intended for mixing powders granulates or polydisperse granular materials.

Cone-and-screw mixers are widely used both for making mixtures of two or more components and for homogenizing raw materials, semi-products and products displaying an excessive scatter of a chemical or physical property, e.g. the concentration of a microelement or the colour intensity, which influences the applicability of the material.

In its characteristic embodiment, the cone-and-screw mixer comprises an inverted-cone vessel accommodating a screw lifter, its axis being parallel to the generatrix of the cone. With the mixer running, the screw lifter performs a planetary motion around the axis of the vessel in addition to rotating about its own axis.

The cover of the container has an opening used for feeding the mixer which in its bottom part has an a pipe fitting provided with a gate valve or any other closing device. Theoretically, such a mixer can be employed either as a continuous mixer or a batch mixer operating on a fill-mix-empty cycle. In practice, however, cone-and-screw mixers are operated batchwise only, mainly for the reason that to make them continuously operating some additional equipment has to be incorporated into the system for controlling the flow rate of the streams flowing into and out of the mixer. The degree of filling the mixer would otherwise be unstable the mixer being periodically overfilled or underfilled and, even sometimes, emptied.

The present state of the art of measuring and controlling the flow rate of granular materials makes it unprofitable to equip a cone-and-screw mixer with an appropriate control system. The purpose of this invention is to eliminate the above problem and to permit cone-and-screw mixers to be widely employed in continuously operating systems. This aim has been achieved by providing the vessel of the cone-and-screw mixer with an overflow opening located in its upper part preferably so that the lower edge of said overflow opening is at the same level as is the upper end of the mixer screw flight. The area of the overflow opening is preferably equal to that of the inlet opening of the mixer. The angle included between the vertical planes passing through the axis of the mixer and through the points being least distant from each other and located on the edges of the overflow and the inlet openings is at least 0.35 rad.

Due to the invention, a cone-and-screw mixer retains all the favourable features of the hitherto employed mixers of this kind, and can be employed as a continuous mixer without it being necessary to use expensive devices to control its degree of filling.

Additionally, in case of setting up a mixing plant comprising some cone-and-screw mixers arranged in series and with the mixed material being transferred by chutes the use of the mixers as described by this invention permits such a mixing plant to be located in rooms of considerably lower heights than those required with the mixers of the design hitherto employed.

Figure 2:
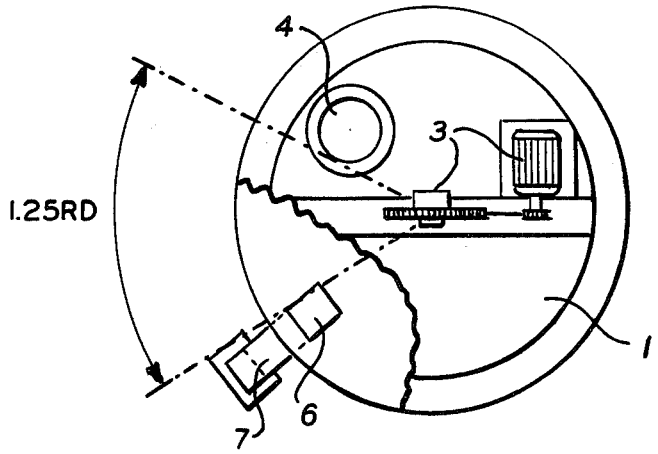

An example of the cone-and-screw mixer made as per this invention is shown in the drawing where FIG. 1 shows a front view of the mixer, and FIG. 2 its top view.

It consists of an inverted-cone vessel 1 accomodating a screw 2 mounted so as to extend along the wall of the vessel parallel to the generatrix of the cone. The screw

2 is driven by an electric motor via a set of gearings 3. The cover of the vessel 1 has an inlet opening 4, and the bottom part of the vessel has a pipe fitting 5, provided with a closing mechanism. The top part of the vessel 1 has an overflow opening 6 having a rectangular cross section and whose lower edge is located at the level of the flight of the screw 2.

The upper edge of the overflow opening 6 is located below the set of gearings 3 accommodated in the vessel 1. The area of the overflow opening 6 is approximately equal to that of the inlet opening 4.

The overflow opening 6 is connected by means of a stub pipe 7 to a downcomer 8 (the upper portion of which is shown in FIG. 1) by which the mixed product is conveyed to another part of the system.

The angle included between the vertical planes passing through the axis of the mixer and through the points least distant from other and located on the edges of the inlet and overflow openings is 1.25 rad.

A cone-and-screw mixer made in the above way has been used for mixing "IXI" washing powder with sodium perborate. The pipe fitting 5 was closed during the operation. The mixer whose degree of filling was kept constant at the level of the top flight of the screw 2 was continuously supplied through the inlet opening 4 with a stream of sodium perborate and a stream of "IXI" washing powder, at such flow rates of components that their mass ratio was about 1:6. By performing a planetary motion around the axis of the vessel 1, the screw 2 mixed the two component streams, distributing them almost immediately throughout the entire bulk of the material contained in the mixer. The mixture flowed out of the overflow opening 6. The successively taken samples of the mixture were characterised by the sodium perborate concentrations of the powder amounting to 16.3, 17.6, 17.4, 16.7, 17.4, 18.7, 16.5, 16.4, 17.6, 17.8, 15.9, 16.3, 16.2 and 14.8 weight per cent. The standard deviation of the concentration throughout the entire bulk of the product thus obtained amounted to 0.8% by weight.

We claim:

1. Apparatus for blending powders, granulate, particulate and similar bulk materials comprising an inverted conical vessel having its central axis substantially vertical disposed, a screw located within said vessel, a cover for said vessel and means for rotating said screw simultaneously about its own axis and about the central axis of the vessel parallel to the wall thereof, inlet means formed in said cover having an opening located for feeding material to said vessel, an overflow opening forming in the wall of said vessel between the inlet opening and the upper flight of the screw, said overflow opening and said inlet opening being radial spaced by an angle defined by the vertical planes passing through the axis of the vessel and points being least distant from each other and located on edges of the overflow and inlet openings, of not less than 0.35 rad., the area of said overflow opening being equal to the area of the inlet.

2. The apparatus according to claim 1 including outlet means for emptying said vessel located at the lower end thereof.

3. The apparatus according to claim 1 including duct means connected to said outlet opening for conducting the overflow therefrom.

4. The apparatus according to claim 1 wherein the lower edge of said overflow opening is level with the upper edge of the upper flight of said screw.

5. The apparatus according to claim 1 wherein said overflow opening is of rectangular cross section.

* * * * *